United States Patent [19]

Pernick

[11] Patent Number: 4,765,155

[45] Date of Patent: Aug. 23, 1988

[54] CIRCULAR KNITTING MACHINE WITH CLOTH TAKE UP SAFETY GATE

[75] Inventor: Bruce M. Pernick, Glendale, N.Y.

[73] Assignee: Monarch Knitting Machinery Corporation, Glendale, N.Y.

[21] Appl. No.: 78,052

[22] Filed: Jul. 27, 1987

[51] Int. Cl.[4] ..... D04B 9/00

[52] U.S. Cl. ..... 66/8; 66/157; 66/151

[58] Field of Search ..... 66/8, 147, 148, 149, 66/157, 151

[56] References Cited

U.S. PATENT DOCUMENTS

| | | | |
|---|---|---|---|
| 3,959,991 | 6/1976 | Brown | 66/8 |
| 3,959,992 | 6/1976 | Eschenbach | 66/8 |
| 4,033,147 | 7/1977 | King | 66/8 |
| 4,718,253 | 1/1988 | Lonati | 66/8 |

*Primary Examiner*—Ronald Feldbaum

*Attorney, Agent, or Firm*—Bell, Seltzer, Park & Gibson

[57] ABSTRACT

The safety gate extends between and normally encloses the entire space between adjacent legs of a circular knitting machine to prevent the operator from being injured by a knit fabric take up roll mechanism which rotates beneath the needle cylinder and extends downwardly between the vertical support legs. The safety gate includes individual safety gate elements which are divided into upper and lower sections with the upper section being supported on the lower section for vertical movement between a raised closed position and a lowered open position. At least one of the gate element is hingedly connected on one side to one of the vertical support legs to permit the safety gate element to swing horizontally between closed and open positions between the vertical legs for permitting removal of the fabric take up roll. The upper section of the safety gate element is movable to the lowered open position to permit access to the area immediately beneath the bed plate without requiring horizontal swinging movement of both the lower and upper sections of the safety gate element.

14 Claims, 2 Drawing Sheets

CIRCULAR KNITTING MACHINE WITH CLOTH TAKE UP SAFETY GATE

FIELD OF THE INVENTION

This invention relates generally to a circular knitting machine with a cloth take up safety gate and more particularly to such a circular knitting machine in which the safety gate is divided into lower and upper sections with the upper section being supported on the lower section for vertical movement between a lowered open position and a raised closed position.

BACKGROUND OF THE INVENTION

The cloth take up roll of a single cylinder plain jersey circular knitting machine is supported for rotation beneath the needle cylinder and on downwardly extending support brackets. It is the normal practice to install cloth take up safety gates which extend between the support legs of the machine and from the needle cylinder bed plate to the floor. One or more of these safety gates is supported for horizontal swinging movement between open and closed positions to permit the removal of the cloth take up roll and to permit the operator to repair press-offs and the like. However, this conventional type of safety gate requires a considerable amount of aisle space to horizontally swing the same between the closed and open positions. These single-piece safety gates do not provide protection for the operator when the gate is opened to repair press-offs or to begin knitting and guide the knit cloth to the take up roll.

In circular knitting machines provided with both a needle cylinder and a dial for knitting rib fabrics and the like, it is the usual practice to provide an intermediate bed plate spaced below the needle cylinder support-bed plate and to support and drive the cloth take up roll from this intermediate bed plate, thereby requiring a complicated gear drive arrangement for the cloth take up roll. In this type of cylinder and dial circular knitting machine, the safety gates extend between the support legs and from the intermediate bed plate to the floor while the space between the intermediate gear plate and the needle cylinder support bed plate remains open.

SUMMARY OF THE INVENTION

With the foregoing in mind, it is an object of the present invention to provide safety gates for use with both circular knitting machines of the single cylinder type and of the cylinder and dial type. In both types of knitting machines the cloth take up roll is directly supported and driven by the needle cylinder so that the complicated gear drive and the intermediate bed plate can be eliminated in cylinder and dial type knitting machines. The safety gates are horizontally divided into upper and lower sections with the upper section being supported on the lower section for vertical movement between a raised closed position and a lowered open position so that the upper section may be vertically moved to the lowered open position to permit easy access to the area immediately beneath the bed plate without requiring horizontal swinging movement of both the lower and upper sections of the safety gate.

In accordance with the present invention, the upper section of the safety gate is supported for vertical movement between a raised closed position and a lowered open position by means of vertical slide rods fixed on the lower section and slide blocks are carried by the upper section and are movable vertically along the slide rods. Counterweight means is associated with the upper section and operates to aid in lifting the upper section to the raised closed position. A locking mechanism is carried by the upper section and cooperates with a locking device carried by the upper bed plate of the knitting machine for maintaining the upper section in the raised and closed position. At least one of the safety gates is hingedly connected at one side to one adjacent vertical leg to permit horizontal swinging movement between open and closed positions to permit removal of the cloth take up roll. The upper section covers approximately one-fourth to one-third of the distance from the upper bed plate to the floor.

BRIEF DESCRIPTION OF THE DRAWINGS

Other objects and advantages will appear as the description proceeds when taken in connection with the accompanying drawings, in which—

DESCRIPTION OF THE ILLUSTRATED EMBODIMENT

Figure 1:
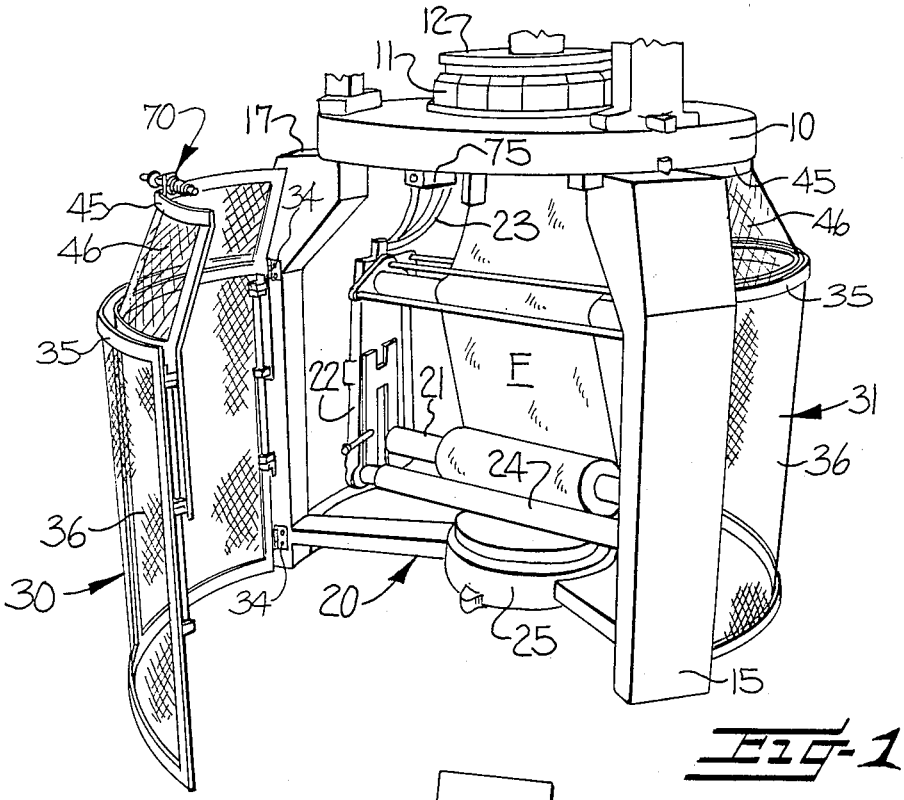
FIG. 1 is a perspective elevational view of the lower portion of a circular knitting machine including a needle cylinder and a dial and illustrating the present safety gate associated therewith.
Figure 2:
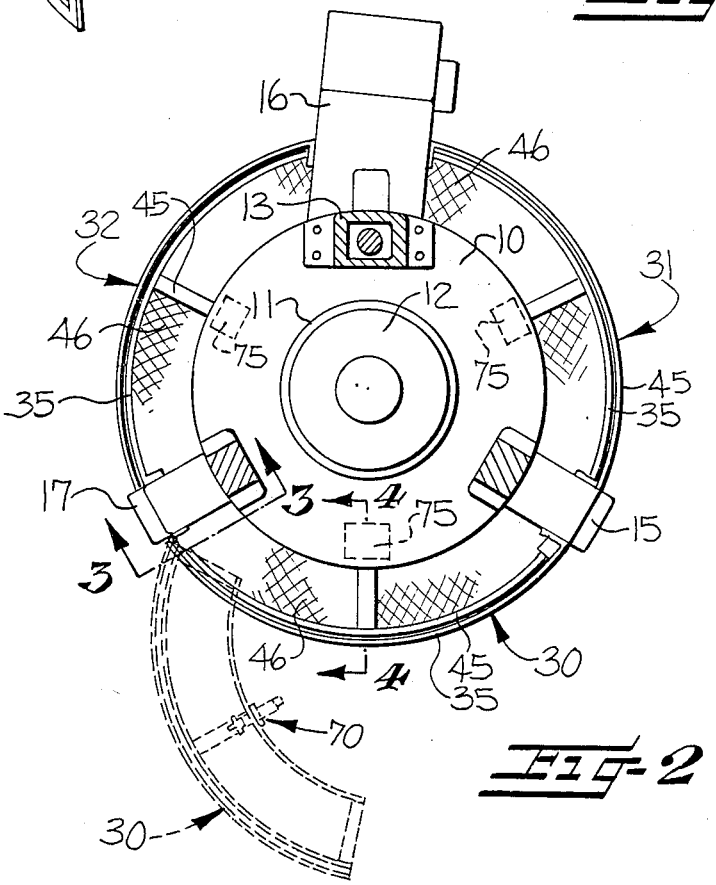
FIG. 2 is a plan view of FIG. 1.

As illustrated in FIGS. 1 and 2, the circular knitting machine includes a frame having a circular bed plate 10 supporting a needle cylinder 11 for rotation thereon. A dial 12 is supported for rotation with the needle cylinder 11 and is driven through a conventional drive mechanism extending through a dial drive support stand 13. Vertical legs 15–17 are spaced around and support the bed plate 10 on the upper ends thereof. As illustrated in FIG. 2, the support leg 16 is wider and heavier than the other two support legs 15, 17 and is commonly referred to as a drive motor support leg.

A knit cloth take up roll mechanism, broadly indicated at 20, extends beneath and has its upper end portion supported for rotation with the needle cylinder 11, and the lower end portion is supported for rotation between the lower ends of the vertical support legs 15–17. The cloth take up roll mechanism 20 includes a cloth take up roll 21 supported for rotation at opposite ends and for vertical movement in side support brackets 22. The upper ends of the side support brackets 22 are supported on support arm brackets 23, the upper ends of which are fixed to the drive for the needle cylinder 11. The lower ends of the side support brackets 22 support driven cloth roll drive rolls 24 which rotate the cloth take up roll 21 in timed relationship to the knitting of the fabric F. The lower end of the cloth take up roll mechanism 20 is rotatably supported on a spider support member 25, fixed to the lower ends of the support legs 15–17.

Figure 5:
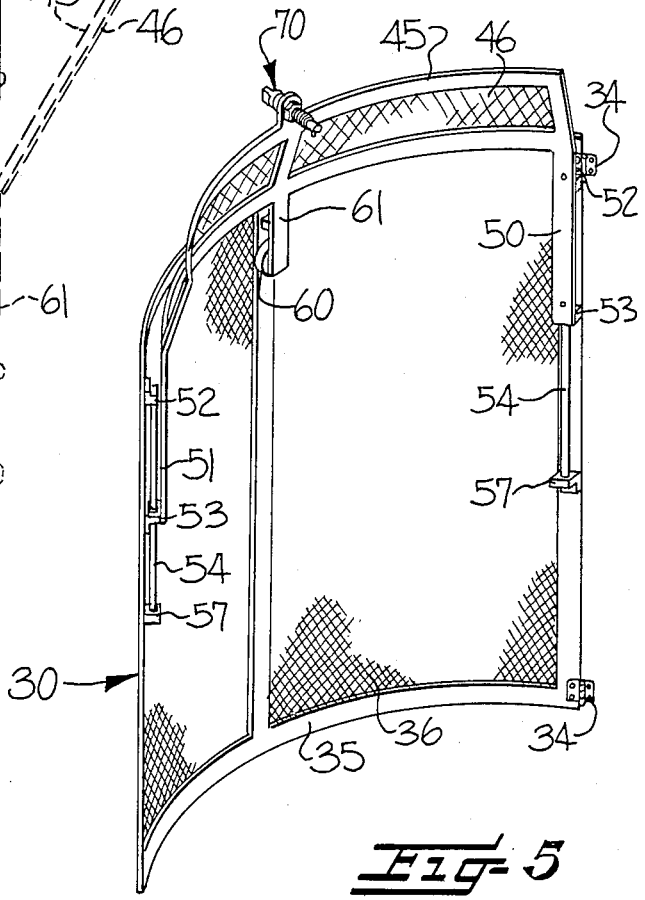
FIG. 5 is an isometric view looking at the inside of one of the safety gates, with the upper section in raised position.

The safety gate mechanism of the present invention completely surrounds the cloth take up roll mechanism 20 of the circular knitting machine and comprises three gate elements, broadly indicated at 30, 31 and 32. Each of the gate elements 30–32 is constructed in the same manner, is semi-circular, extends between and normally encloses the entire space between adjacent of the vertical support legs 15–17. The safety gate elements 31, 32 are normally maintained in a fixed or nonhinged position while the gate element 30 is supported adjacent one edge by upper and lower hinge members 34 attached on one side of the support leg 17 (FIG. 5). The hinges 34 permit the safety gate element 30 to horizontally swing outwardly, as illustrated in solid lines in FIG. 1, and in dotted lines in FIG. 2, to provide access for removal of the cloth roll 21 when the cloth wound thereon has reached the maximum diameter. Since each of the safety gate elements 30, 31 and 32 is constructed in the same manner, only the safety gate element 30 will be described in detail and corresponding parts of the other safety gate elements 31, 32 will bear like reference characters.

Figure 3:
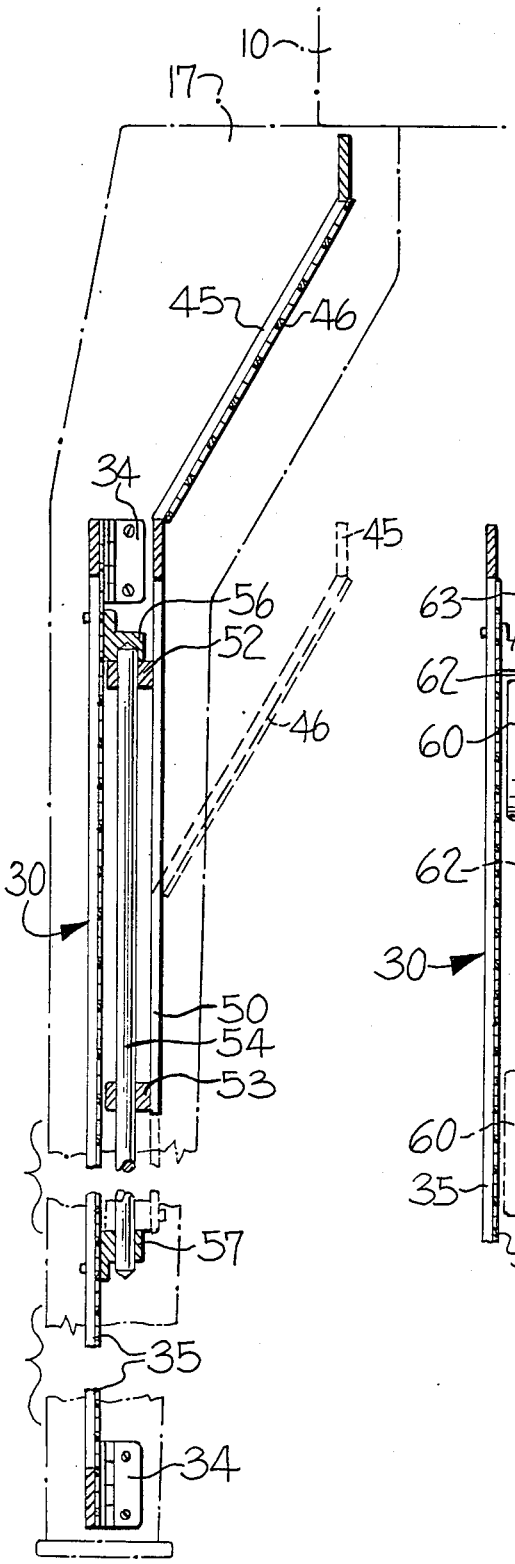
FIG. 3 is an enlarged vertical sectional view taken substantially along the line 3—3 in FIG. 2 and with portions of the lower area being broken away.

The safety gate element 30 includes a lower section formed of an open semi-circular frame 35 covered with a wire mesh material 36 and including interconnected upper and lower horizontal frame members, opposite side frame members, and a medial vertical frame member. The gate element 30 also includes an inwardly inclined upper section including an open frame 45 which converges inwardly and is covered with a wire mesh material 46. The upper frame 45 includes interconnected upper and lower frame members, outer side frame members, and a medial support frame member. Outer leg members 50, 51 extend downwardly from the lower frame member or rail of the upper section open frame 45 and have spaced-apart upper and lower slide blocks 52, 53 (FIG. 3) fixed to the inner surface thereof.

The spaced slide blocks 52, 53 are supported for vertical sliding movement on vertical slide rods 54. The upper and lower end portions of the slide rods 54 are fixed in upper and lower support brackets 56, 57, fixed on the opposite sides of the lower frame member 35. Thus, the upper section of the gate element 30 is supported on the lower section for vertical movement between a raised closed position, as shown in FIGS. 1 and 3–5, and a lowered open position, as shown in dotted lines in FIGS. 3 and 4, with the upper edge portion of the upper section being substantially horizontally aligned with the upper edge portion of the lower section to permit access to the area immediately beneath the bed plate 10, without requiring horizontal swinging movement of both the lower and upper sections of the safety gate, as shown in FIG. 1.

Figure 4:
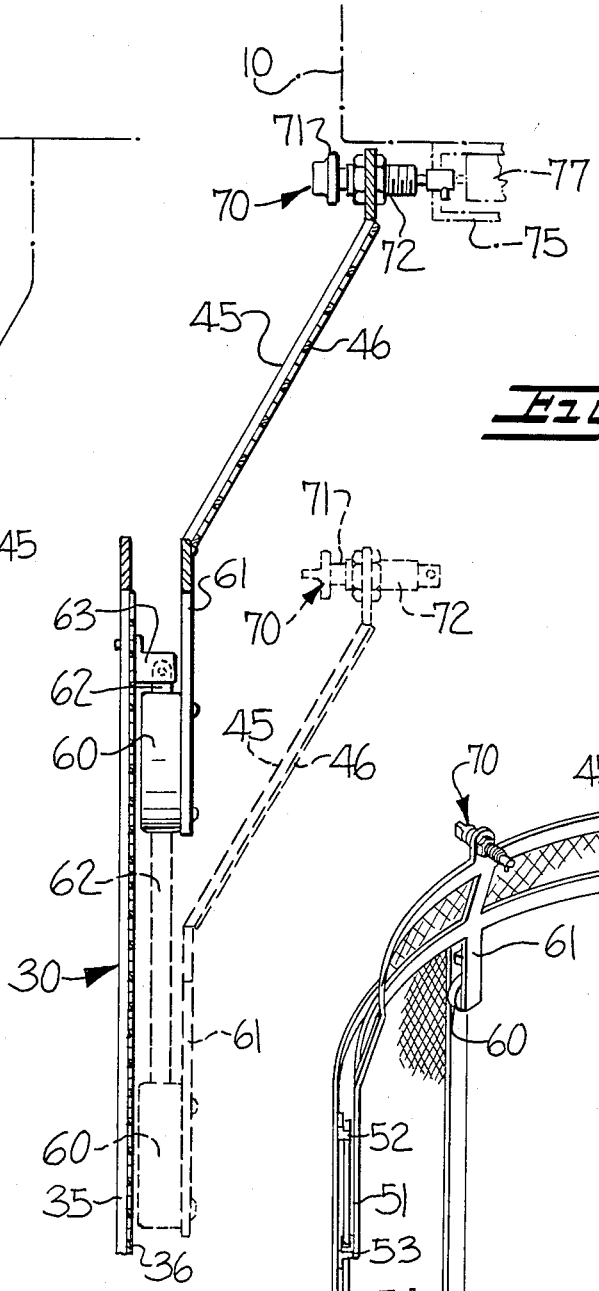
FIG. 4 is an enlarged vertical sectional view taken substantially along the line 4—4 in FIG. 2 and showing the upper portion of the safety gate in cross section.

Counterweight or counterbalance means is provided for aiding in lifting the upper section of the gate 30 and includes a counterweight spring member 60 (FIG. 4) fixed on the lower end of a medial downwardly extending leg 61 connected at its upper end on the upper section. The free end of a tape spring 62 is fixed on a support bracket 63 carried by the upper portion of the lower section of the gate 30 (FIG. 4). When the upper section is moved to the lowered dotted line position shown in FIG. 4, the tape 62 is drawn out of the housing of the spring member 60 and has a tendency to be drawn back into the housing so that it acts as a counterweight and aids in again lifting the upper section to the closed solid line position shown in FIG. 4. The spring member 60 can be of any suitable type and is illustrated as being of the type normally used as a counterweight in a sash type window.

The upper section 45 is provided with a closed position locking mechanism, broadly indicated at 70. The locking mechanism includes a locking plunger 71 supported for rotation and longitudinal movement in a support sleeve 72, suitably connected to the upper rail portion of the upper section frame 45. The locking plunger 71 is normally urged to an outermost position by a compression spring, not shown, surrounding the locking plunger 71 and housed in the support sleeve 72.

The inner end of the locking plunger 71 is adapted to be selectively engaged with a keyhole opening in the outer face of a control box 75 fixed on the lower surface of the bed plate 10. The control box 75 includes a normally open electric switch 77 (FIG. 4). The upper section of the gate 30 is locked in the raised position by pushing inwardly on the spring pressed locking plunger 71 so that the inner end enters the key slot and then rotating the spring pressed locking plunger 71 so that an outwardly extending pin prevents outward movement of the plunger 71. When the locking plunger 71 is in the innermost and locked position shown in FIG. 4, the inner end thereof engages and closes the normally open switch 77 so that the machine can operate in the normal manner.

When it is desired to remove a full cloth take up roll 21, the operator merely rotates the locking plunger 71 so that the inner end will move out of locking engagement with the control box 75. The gate element 30 can then swing in a horizontal direction to the outermost position to provide full access to remove the cloth take up roll 21 from between the support legs 15, 17. The machine will not operate in the normal manner with the gate in the open position since the stop switch 70 will be in the open position, although limited operation of the knitting machine is possible by pushing the "jog" switch button.

In some instances, it is desirable to gain access to the area immediately beneath the bed plate 10 without swinging the gate 30 to the open position, such as when a cloth press-off occurs. In these instances the upper section of the safety gate element 30, and/or the gate elements 31, 32, can be lowered to an open position by simply rotating the plunger 71 so that the spring urges the plunger outwardly and out of locking engagement with the control box 75. The upper section of the gate is then lowered along the slide rods 54 to a position where the upper level of the upper section is substantially horizontally aligned with the upper level of the lower section of the safety gate 30. To return the upper section of the gate 30 to its normal closed position, the operator merely lifts the upper section, with the aid of the counterweight mechanism 60, and moves the plunger 70 inwardly so that its inner end enters the keyhole slot in the support box 75 and rotates the locking plunger 70 to maintain it in locked engagement with the control box 75. At the same time, the inner end of the plunger 71 engages and moves the plunger of the switch 77 inwardly to permit normal operation of the circular knitting machine.

The vertical length of the upper section of each of the gate elements 30–32 can be varied, relative to the vertical length of the corresponding lower section, so that access is provided to the upper area beneath the bed plate 10, without requiring outward swinging movement of the safety gate. It is preferred that the upper section cover approximately one-fourth to one-third of the distance from the upper bed plate 10 to the floor. In the drawings, the upper section is illustrated as covering approximately one-fourth of the distance between the bed plate 10 and the floor.

The safety gate of the present invention thus protects the knitting machine operator from engagement with the rotating cloth take up mechanism extending beneath the knitting machine. The safety gate also provides easy access to the area immediately beneath the bed plate, without requiring horizontal swinging movement of both the lower and upper sections of the safety gate. Further, the present safety gate permits the cloth take up of a cylinder and dial type knitting machine to be supported on the needle cylinder and rotated therewith, thereby eliminating the intermediate gear drive plate normally required in a cylinder and drive type knitting machine.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a circular knitting machine having a frame including a circular bed plate supporting a needle cylinder for rotation thereon, vertical legs spaced around and supporting said bed plate on the upper ends thereof, and a knit fabric take up roll mechanism having an upper end supported for rotation beneath and with said needle cylinder, the combination therewith of safety gate means including a safety gate element positioned between and normally enclosing each of the entire spaces between adjacent of said vertical legs, at least one of said safety gate elements including (a) lower and upper sections, and (b) means supporting said upper section on said lower section for vertical movement between a raised closed position adjacent said bed plate and a lowered open position, said upper section being vertically movable to the lowered open position to permit access to the area immediately beneath said bed plate.

2. A circular knitting machine according to claim 1 including locking means associated with said upper section of said one of said safety gate elements and being manually operable to maintain said upper section in the raised closed position.

3. A circular knitting machine according to claim 2 wherein said locking means includes a longitudinally slideable locking plunger carried by said upper section, and including a control box fixed on said bed plate and being engageable by said locking plunger to maintain said upper section in the raised closed position.

4. A circular knitting machine according to claim 3 including switch means supported in said control box and being engageable by said locking plunger when engaged with said control box to permit normal operation of said knitting machine and preventing normal operation of said knitting machine when said locking plunger is out of engagement with said control box.

5. A circular knitting machine according to claim 1 wherein said means supporting said upper section on said lower section for vertical movement includes spaced vertical guide rods fixed on said lower section, and slide blocks fixed on said upper section and being vertically movable along said guide rods.

6. A circular knitting machine according to claim 5 including counterweight means attached to said upper section for aiding in moving said upper section from said lower open position to said upper closed position.

7. A circular knitting machine according to claim 1 wherein said upper section extends downwardly from said bed plate a distance equal to approximately one-fourth to one-third the distance from said bed plate to the floor, and wherein said lower section extends upwardly from the floor to the lower edge of said upper section.

8. A circular knitting machine according to claim 7 wherein said upper section extends downwardly from said bed plate a distance equal to approximately one-fourth the distance from said bed plate to the floor.

9. A circular knitting machine according to claim 1 wherein said one of said safety gate elements includes hinge means connecting one side of said lower section to an adjacent vertical leg for permitting said safety gate element to swing horizontally between closed and open positions between adjacent legs.

10. A circular knitting machine according to claim 1 wherein the remaining of said safety gate elements also include lower and upper sections identical to said lower and upper sections of said one of said safety gate elements.

11. In a circular knitting machine having a frame including a circular bed plate supporting a needle cylinder for rotation thereon, vertical legs spaced around and supporting said bed plate on the upper ends thereof, and a knit fabric take up roll mechanism having an upper end supported for rotation beneath and with said needle cylinder, the combination therewith of safety gate means extending between and normally enclosing the entire space between adjacent of said vertical legs, said safety gate means including at least one semi-circular safety gate element extending between a pair of adjacent legs and comprising (a) lower and upper sections, (b) hinge means connecting one side of said lower section of said safety gate element to adjacent vertical leg for permitting said safety gate element to swing horizontally between closed and open positions between said adjacent legs, and (c) means supporting said upper section on said lower section for vertical movement between a raised closed position adjacent said bed plate and a lowered open position, said upper section being vertically movable to the lowered open position to permit access to the area immediately beneath said bed plate without requiring horizontal swinging movement of both said lower and upper sections of said safety gate element.

12. A circular knitting machine according to claim 11 including locking means carried by said upper section and being manually operable to maintain said upper section in the raised closed position.

13. A circular knitting machine according to claim 11 wherein said means supporting the upper section on said lower section for vertical movement includes spaced guide rods supported in a fixed position on said lower section, slide blocks carried by said upper section and vertically movable along said guide rods, and counterweight means associated with said upper section for aiding in moving said upper section from said lower open position to said upper raised closed position.

14. A circular knitting machine according to claim 11 wherein the remaining of said safety gate elements also include lower and upper sections identical to said lower and upper sections of said one of said safety gate elements.

* * * * *